US005704191A

United States Patent [19]

Wallace et al.

[11] Patent Number: 5,704,191

[45] Date of Patent: Jan. 6, 1998

[54] LOW STRESS BATT FOLDER

[75] Inventors: Keith Wallace, Corunna, Canada; Charles R. Weir, Westerville, Ohio

[73] Assignee: Owens-Corning Fiberglas Technology, Inc., Summit, Ill.

[21] Appl. No.: 541,163

[22] Filed: Oct. 11, 1995

[51] Int. Cl.[6] ..... B65B 63/04

[52] U.S. Cl. ..... 53/116; 53/117; 53/529

[58] Field of Search ..... 53/116, 117, 119, 53/120, 528, 539, 530

[56] References Cited

U.S. PATENT DOCUMENTS

| | | | |
|---|---|---|---|
| 1,166,737 | 1/1916 | Baird | 53/119 |
| 3,161,000 | 12/1964 | Hannon et al. | 53/120 |
| 3,691,721 | 9/1972 | Hannon et al. | 53/120 |
| 4,106,260 | 8/1978 | King | 53/120 X |
| 4,805,374 | 2/1989 | Yawberg . | |
| 4,817,365 | 4/1989 | Yawberg et al. . | |
| 4,833,863 | 5/1989 | Scott et al. . | |
| 5,493,841 | 2/1996 | Van Wegen et al. | 53/119 |

*Primary Examiner*—Daniel Moon

*Attorney, Agent, or Firm*—C. Michael Gegenheimer; Curtis B. Brueske

[57] ABSTRACT

An apparatus for folding a fibrous insulation batt having a length and a width is disclosed. The batt has first and second sections, where each section is approximately one half the length of the batt. The apparatus comprises a lower conveyor for conveying folded batts in a first direction, and an upper conveyor which is positioned above the lower conveyor and move in the first direction to define a folded batt exit path. The apparatus further comprises a folding member for folding the insulation batt, where the folding member is adapted to contact the batt across its width. The folding member is mounted for movement to initially push the batt in a second direction, and then subsequently push the batt in the first direction, thereby pushing the batt along the folded batt exit path. The movement of the folding member folds the batt so that the first section of the folded batt is generally parallel to and contacting the second section.

20 Claims, 5 Drawing Sheets

LOW STRESS BATT FOLDER

Related copending U.S. application Ser. No. 08/540,629 was filed on even date herewith.

TECHNICAL FIELD

This invention relates to the folding of a length of a fibrous insulation batt.

BACKGROUND ART

Fibrous insulation material is typically manufactured in common lengths and widths, called insulation batts, to accommodate typical building frame structure dimensions. Fibrous insulation batts are commonly made of mineral fibers, such as glass fibers, and usually have a density within the range of from about 0.2 to about 1.0 pounds per cubic foot (3.2 to 16 kg/m$^3$). Typical batt sizes are 16 or 24 inches (40.6 cm or 61.0 cm) wide by 8 feet long (2.44 m). These batts can be packaged in various ways. The batts can be staggered and rolled together along their lengths so that a roll would contain about 10 batts. Alternatively, the batts can be stacked on top of each other, compressed and then packaged in plastic bags. Because of size constraints it is desirable to fold the batts in half along their lengths and stack them together, thereby forming a stack which is about 4 feet (1.22 m) long. The invention as described herein pertains to the packaging of the folded batts.

The batts can be folded manually or by a machine, such as the batt folder as described in U.S. Pat. No. 4,805,374 to Yawberg. The batts are folded by a ram which pushes on the center of the batt to fold the batt into two halves. The ram inserts the folded batt between two conveyors. Because of the linear movement of the ram, the folded batt has to change from one direction to another by the use of multiple conveyor surfaces. This change in direction pulls and stretches the fibrous insulation material of the batt. The height between the conveyors is small compared to the thickness of the batt. The height is small to insure that the batt moves from one conveyor to another when the batt changes direction. This small height compresses the insulation batt and reduces the recovery thickness after the batt is unpackaged. The conveyor height must also be small to accommodate the frictional forces exerted by the linear ram when the ram retracts back between the compressed surfaces of the batt. These frictional forces retard the progress of the batt through the conveyors. The detrimental small vertical height between the conveyors assures that the ram will not pull the batt backwards as the ram retracts. After the ram pushes the batt between the two conveyors, the conveyors grab the folded batt and pull the batt towards another set of conveyors which move the batt to a packaging machine. The conveyor deposits the folded batt horizontally into a packaging machine where the batt is stacked on top of other folded batts. The batts are then compressed and packaged into a plastic bag.

It would be desirable to have a method of folding fibrous insulation batts which does not put a high level of stress on the batt so that recovery thickness is not reduced.

DISCLOSURE OF INVENTION

There has now been invented an improved apparatus for folding fibrous insulation batts which does not put a high level of stress on the batt so that recovery thickness is not reduced.

The batt folder of the present invention folds fibrous insulation batts having a length and a width. The batts have first and second sections, where each section is approximately one half the length of the batt. The batt folder comprises a lower conveyor and an upper conveyor. The lower conveyor conveys the folded batts in a first direction. The upper conveyor is positioned above the lower conveyor and moves in the first direction to define a folded batt exit path. The batt folder further includes a folding member for folding an insulation batt. The folding member is adapted to contact the batt across its width, and is mounted for movement to initially push the batt in a second direction. The folding member pushes the batt first along the second direction and then along the first direction, thereby pushing the batt along the folded batt exit path. The movement of the folding member folds the batt so that the first section of the folded batt is generally parallel to and contacting the second section.

In a specific embodiment of the invention, the folding member can be mounted for movement in an arcuate path. The folding member includes a pivotally mounted arm having a contact element positioned on the arm for contacting and pushing the batt. The contact elements can be comprised of rods which extend across the width of the insulation batt. The contact elements can be retractably mounted on the arm to enable disengagement of the contact member from the folded insulation batt after the batt has been pushed into the folded bar exit path.

In another specific embodiment of the invention, the contact element comprises first and second contact elements that are spaced apart and adapted to contact the batt across its width and between the first and second sections. The movement of the folding member and the two contact elements creates two spaced apart folds across the width of the batt as the batt is being folded and pushed into the folded batt exit path. The first and second contact elements can each be comprised of a pair of rods extending partly across the width of the batt so that each pair can be retracted from the insulation batt. The rods may also be adjustably mounted on the arms to accommodate different batt thicknesses.

In a specific embodiment of the batt folder, the batt folder comprises a curved support plate for supporting the first section of the insulation batt prior to folding. In yet another specific embodiment of the batt folder, the batt folder comprises a deflector for rotating the first section of the batt around the upper conveyor to align the first section of the batt generally along the second direction. The deflector can be pivotally attached to the folding member so that the pivoting action of the folding member causes the deflector to rotate the first section of the batt around the upper conveyor to align the first section of the batt generally along the second direction.

BEST MODE FOR CARRYING OUT THE INVENTION

Figure 1:
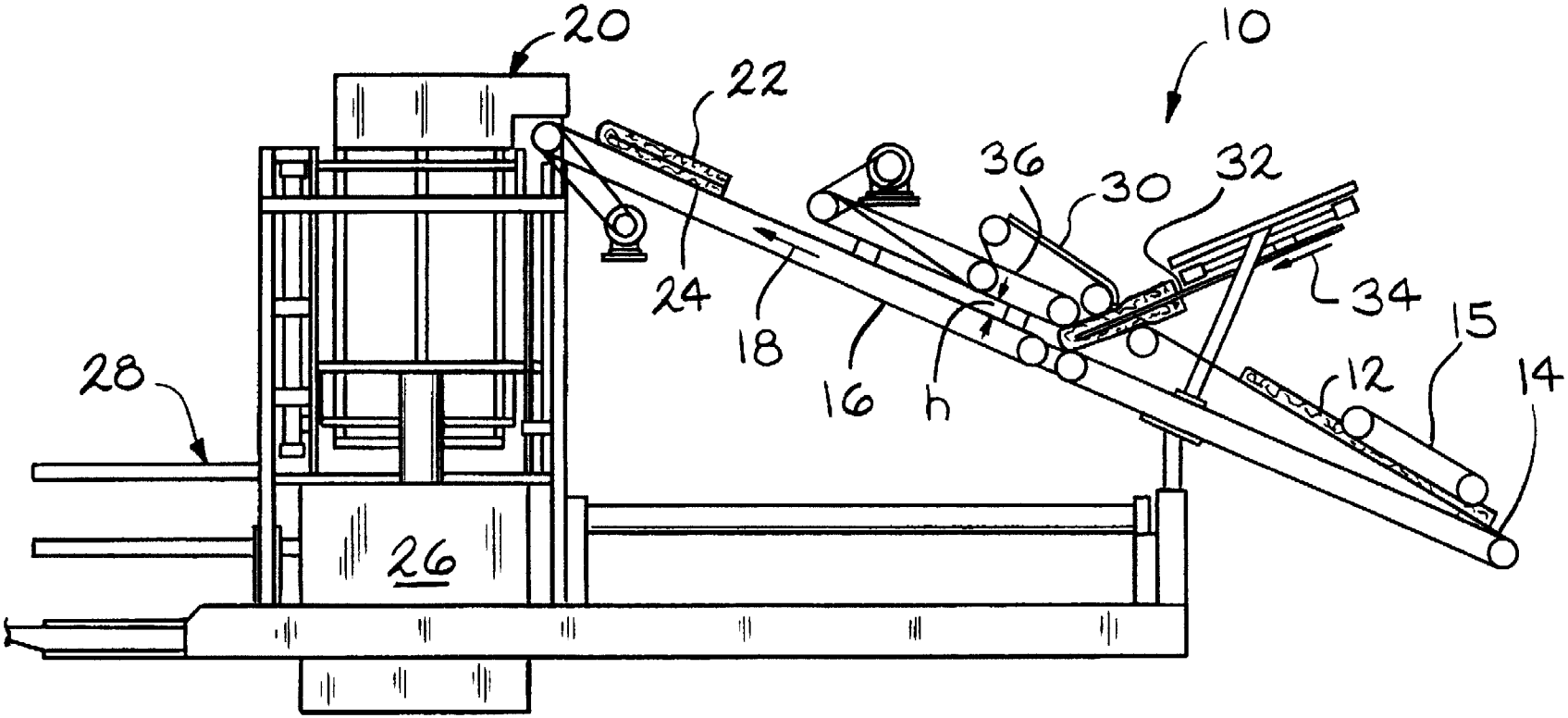
FIG. 1 PRIOR ART
FIG. 1 is a side elevational view of a prior art batt folder, packaging machine and bagging apparatus.

There is illustrated in FIG. 1 a prior art batt folder generally indicated at 10, and as described in U.S. Pat. No. 4,805,374 to Yawberg. An unfolded fibrous insulation batt 12 is delivered to the batt folder by an upstream conveyor 14. Prior to the folding of the insulation batt, the batt can be temporarily compressed by a conveyor 15 which is parallel to the upstream conveyor 14. The conveyor 15 is raised above the upstream conveyor 14 a distance less than the thickness of the batt. The compression "softens" the insulation material and reduces the tendency of the folded batt to unfold. Softening compresses the insulation product so it is not as stiff and does not recover back to its optimum height. Thus, the resistance to unfolding is not as great in softened fibers as in unsoftened fibers. The softening is not necessary on some types of insulation batts, such as those with low density or having small thickness.

After the batt has been softened, if needed, the batt folder then folds the batt and delivers the folded batt by a downstream conveyor 16, moving in a first direction 18, to a packaging machine 20. The batt is folded in half so that a first section 22 of the batt is lying generally flat and on top of a second section 24. The packaging machine includes a stacker 26 which stacks the folded batts horizontally until a desired number is reached. The stack is then compressed by the stacker and the stack of batts is inserted into a plastic bag by a bagging apparatus 28. The packaged batts are then ready for final shipping.

To fold the insulation batt, the batt is delivered by the upstream conveyor 14 until the unfolded batt is suspended by the upstream conveyor and a skid plate 30. The top section of the unfolded batt rests on the skid plate and the bottom section rests on the upstream conveyor. A ram 32 is linearly driven into the center of the suspended batt and is pushed by the ram in a second direction 34. The batt is folded as the ram pushes on the center of the batt and forces the batt between an upper conveyor 36 and the upstream conveyor 14. The folded batt then changes direction from the second direction to the first direction as the folded batt is pulled along between the upper conveyor and the downstream conveyor. The batt is softened as it travels through the conveyors, and therefore, pre-softening by conveyor 15 before folding may be unnecessary. The downstream conveyor then delivers the folded batt to the packaging machine.

Pulling the batt through the changes in direction requires high frictional forces between the conveyor surfaces and the batt. To achieve the high frictional forces needed to move the batt between the conveyors, high compression is required. The height between the downstream conveyor 16 and upper conveyor 36 is indicated at h. For example, a 6 inch (15.2 cm) thick batt would require a height h within the range of about 2 inches (5.1 cm). This high compression and the stretching action which occurs as the compressed batt is bent from the second direction to the first direction damages the batt. The batt's recovery thickness after it is unpackaged is lowered due to the damage caused by the conveyors.

Figure 2:
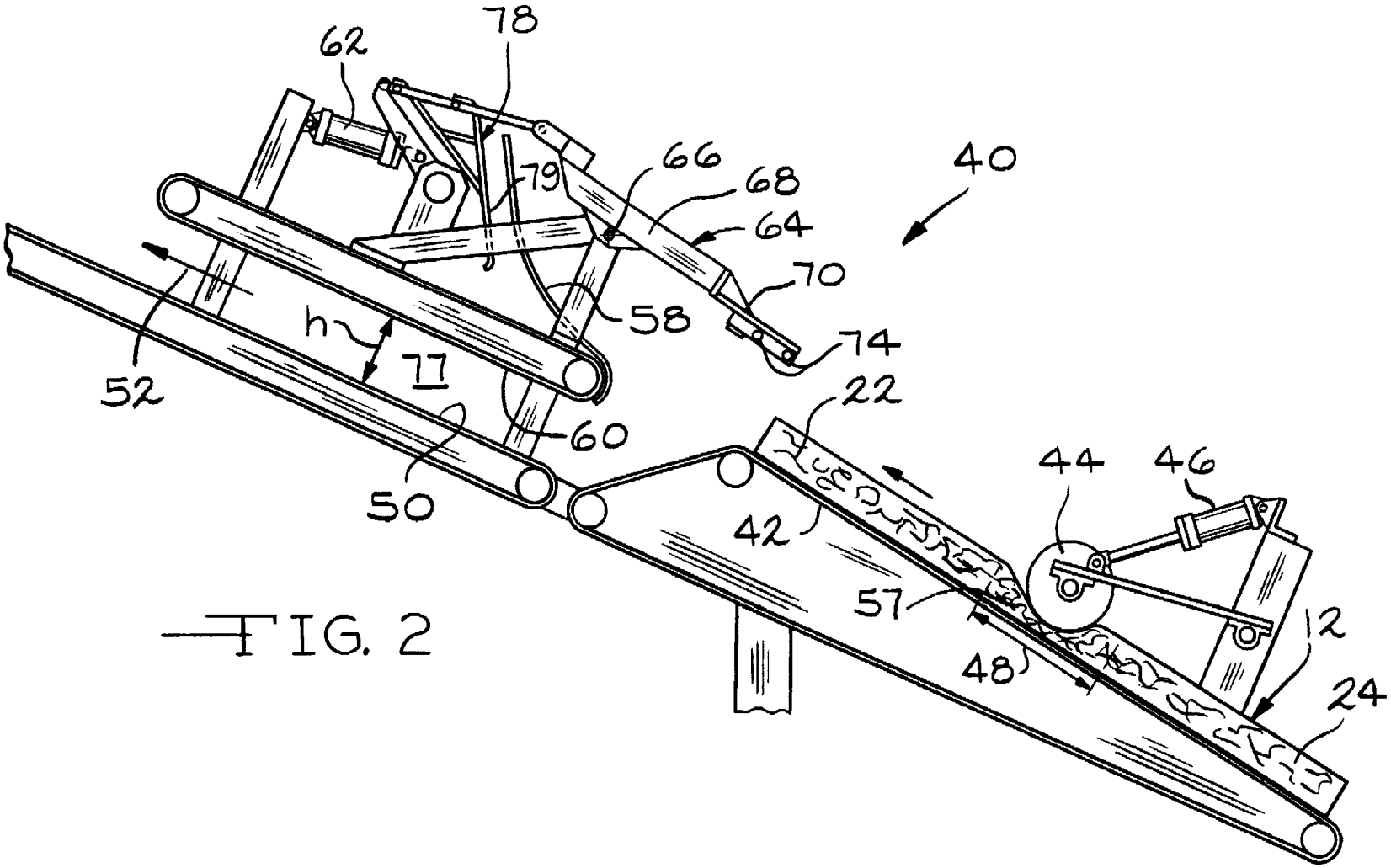
FIG. 2 is a side elevational view of the batt folder of the present invention.

The batt folder of the present invention is shown in FIG. 2 and generally indicated at 40. The unfolded insulation batt 12 is delivered to the batt folder by an upstream conveyor 42. Prior to the folding of the batt, the batt is optionally softened by roller 44 which is actuated by pneumatic cylinder 46. Since the softening decreases the overall recovery height of the unpackaged batt, only a small portion of the batt is softened. This small portion is defined as a compression zone 48. The compression zone extends across the width of the batt and covers the area of the batt which is folded and under compression when the batt is in a folded condition. The compression zone is located generally in the center of the length of batt, between the first and second sections, and preferably has a length within the range of from about 4 to about 20 inches (10.2 cm to about 50.8 cm).

After being softened, the batt is delivered to the batt folder where the batt is folded and conveyed to the packaging machine 20 by a downstream conveyor 50. The downstream conveyor moves in a first direction defined as an exit path direction 52.

The first section 22 of the batt is the leading end of the batt as the batt moves on top of the upstream conveyor. The second section 24 of the batt is the trailing end of the batt. The first and second sections are separated by a center section 57. The first and second sections are each approximately equal to one half the length of the batt. When the batt is folded, the first section will lie on top of the second section so that both sections will be generally parallel to each other. The center section will be the section of the batt which is folded or creased. The center section of the batt is shorter in length compared to the compression zone 48, because the softened compression zone is preferably slightly longer to insure that the entire length of the center section is softened.

Figure 3:
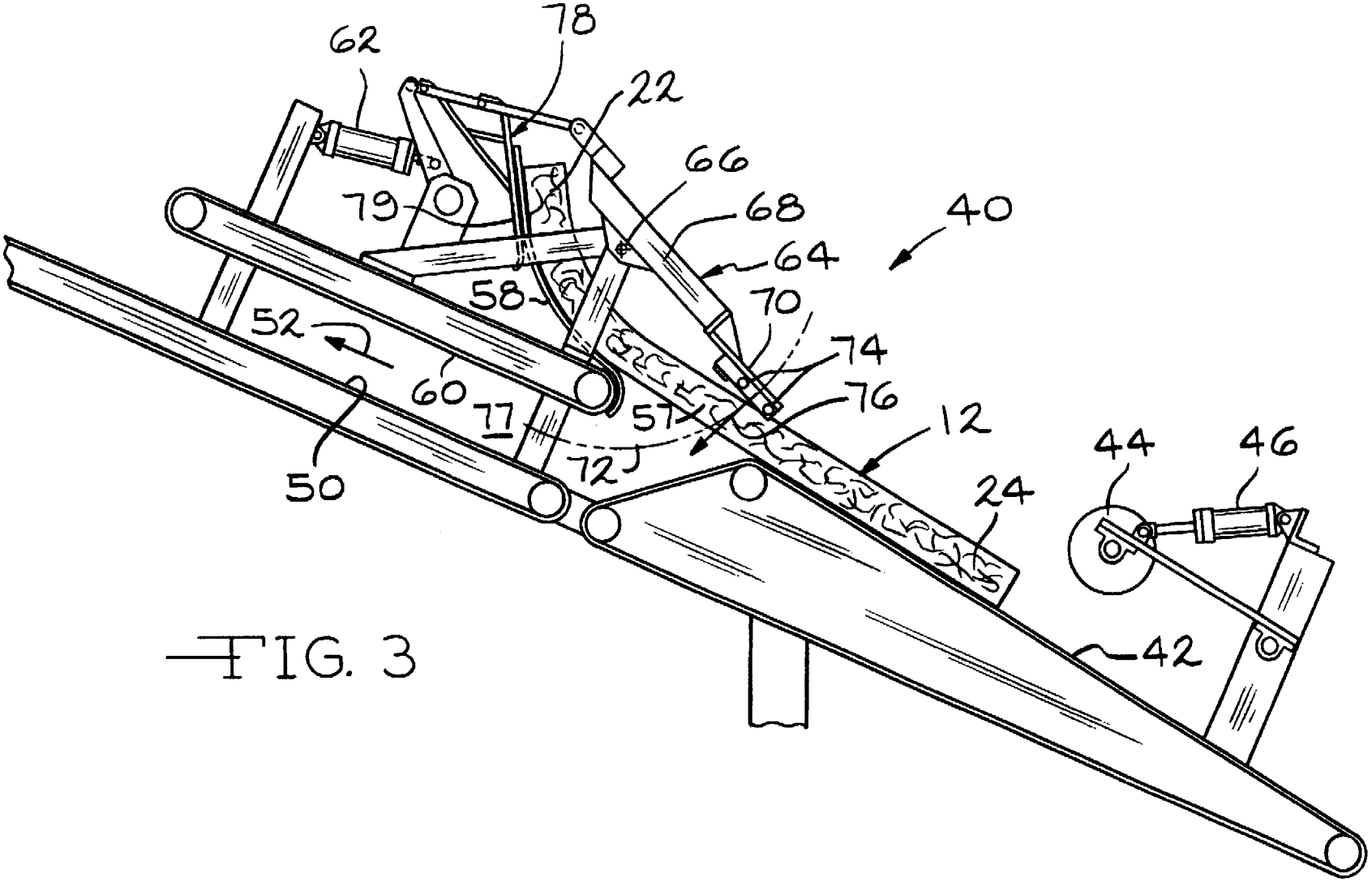
FIG. 3 is a side elevational view of the batt folder of FIG. 2, where the insulation batt is in a position prior to being folded.
Figure 4:
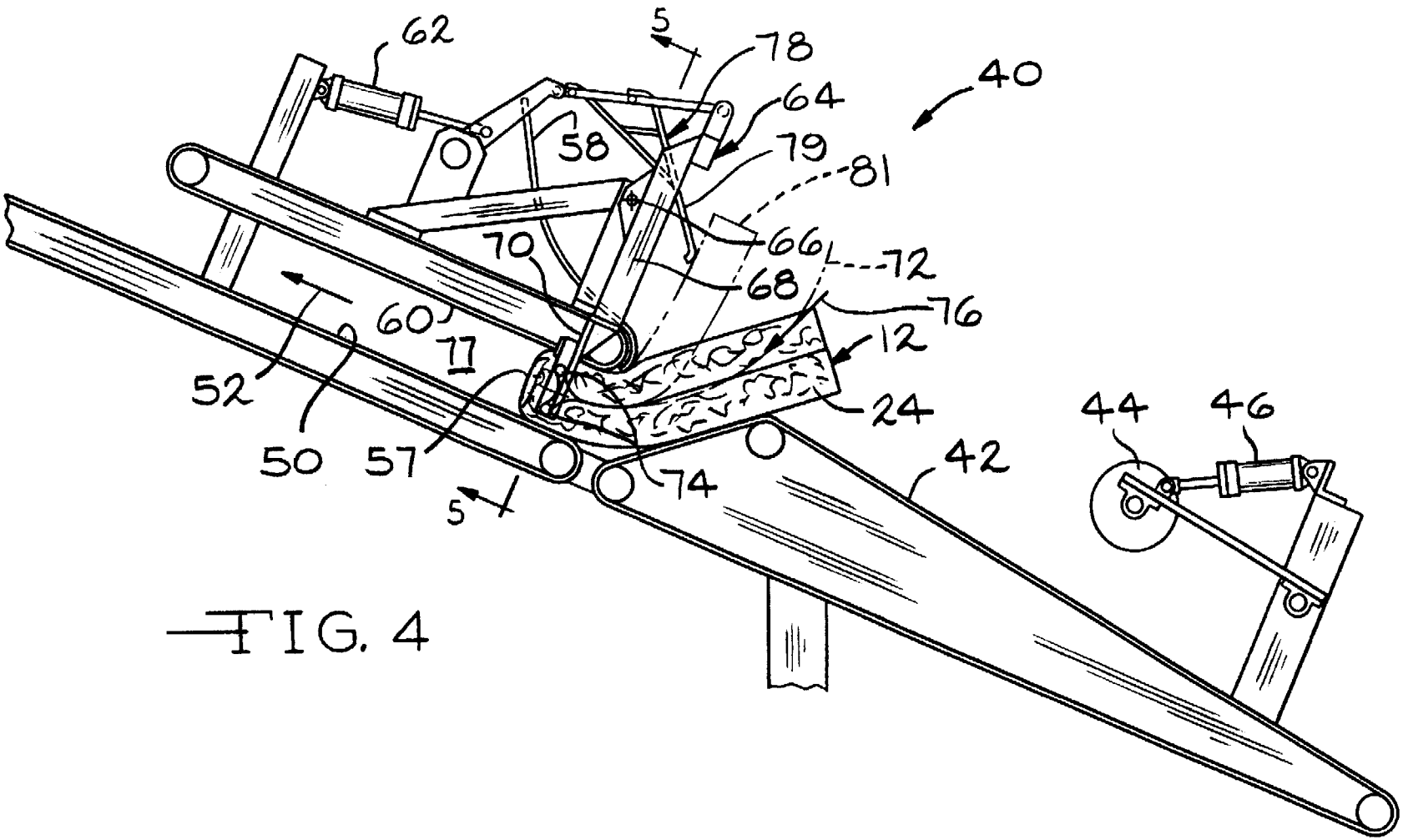
FIG. 4 is a side elevational view of the batt folder of FIG. 2, where the insulation batt is being folded.

FIGS. 2 through 4 illustrate the sequence of folding the insulation batt by the batt folder. As shown in FIG. 2, the batt is being softened in the batt's compression zone by the softening roller 44. A portion of the first section 54 of the batt is upheld by a curved support plate 58. An upper conveyor 60 is positioned underneath the support plate. The upper conveyor is moving in the exit path direction 52 and is positioned above the downstream conveyor 50.

As shown in FIG. 3, the batt is pushed up the curved support plate 58 by the upstream conveyor 42 until the center section 57 of the batt is positioned between the upstream conveyor and the support plate. When the center section of the batt is correctly positioned, a pneumatic cylinder 62 is actuated causing a folding member 64 to rotate about pivot axis 66. Broadly, the folding member folds the batt by pushing the center section 57 of the batt between the upper conveyor 60 and the downstream conveyor 50.

In the preferred embodiment, the folding member includes two arms 68 which are pivotally mounted about a fixed pivot axis 66. The arms have ends 70 that travel in an arcuate path 72 about axis 66. Contact elements in the form of a pair of rods 74 are retractably mounted at the ends of each arm. The rods are the only part of the folding member which contacts the batt. The contact elements do not have to be rods, but can be of any shape that allows the batt to be folded as the contact elements push on the center of the batt.

Although there are shown two contact elements to create a dual-folded batt, the invention will also work equally well with a single contact element to create a single-folded batt. The dual-folded batt is preferable over the single-folded batt because of the tendency of the dual-folded batt to stay folded and remain relatively flat. The two folds reduce the tendency of the top section to lift or spring up from the bottom section. By distributing the compression of insulation over two folds the batt does not have enough springiness to lift the top section above the bottom section and the batt is kept folded by the weight of the top section alone. Also, the thickness at the folded end is increased so that the thickness of the folded batt is more uniform when comparing the folded end to the unfolded end, in contrast to a single-folded batt where the two ends are not of the same thickness.

To fold the batt, the unfolded batt is first positioned so that the center section of the batt is positioned between the upstream conveyor and the support plate, as shown in FIG. 3. When the pneumatic cylinder 62 is actuated, the arm travels in the arcuate path 72 and the rods contact the center section of the batt. At that moment, the rods are pushing the batt in a second direction, a folding direction 76, which is tangent to the arcuate path. The rods continue to push the center of the batt in a direction tangent to the arcuate path until the pushing direction is parallel to the exit path direction 52, as seen in FIG. 4. The rods are then retracted in a direction parallel to the width of the batt so that the rods no longer contact the batt. The center of the batt is then positioned between the upper conveyor 60 and the downstream conveyor 50 with the two conveyors defining as a folded batt exit path 77.

Although it is shown that the batt is moved in an arcuate path to move the batt from the folding direction 76 to the exit path direction 52, the batt can be moved in any other suitable fashion, such as a combination of linear movements. It is important to push the batt into the exit path so that the conveyors are not performing the actual folding of the batt by pulling the first and second sections into the exit path. Pulling on the batt by the conveyors, as in the prior art batt folder 10, requires high frictional forces which requires high compression between the upper conveyor and the downstream conveyor. The batt will be damaged by the stretching of the insulation material if the batt is pulled and bent around the conveyor surfaces and through direction changes. In the batt folder 40 of the present invention, the arm 68 pushes the batt to the exit path 77 at generally the same speed as the conveyors to prevent the stretching of the insulation material. The batt folder 40 does not need to pull the batt into the conveyors because the arm pushes the batt through the changes in direction, that is, from the folding direction 76 to the exit path direction 52. Because the conveyors do not need to pull the two sections of the batt to fold the batt, the batt is subjected to less stress. The height h between the downstream conveyor 50 and upper conveyor 60 can be much larger than the prior art batt folder 10 of FIG. 1. For example, the 6 inch (15.2 cm) thick batt when folded to a double width of about 12 inches would require a height h of about 2 inches (5.1 cm) for the prior art batt folder 10, but the batt folder of the present invention 40 would only require a height of about 9 inches to about 11 inches (22.9 cm to about 27.9 cm).

The reduction of the dependence on friction to fold the batts between the conveyors allows the folding process to be more accurate, thereby insuring that the first section 22 and second section 24 are more nearly equal in length after folding. The variation in lengths of the two sections of the folded batt is reduced by about 50% when compared to the prior art batt folder 10. Also, the batt folder 40 of the present invention is able to fold batts of longer lengths than the prior art batt folder when using the same packaging machine. For example, the prior art batt folder was limited to batt lengths of 96 inches (2.44 m), but the batt folder of the present invention can fold batts having a length up to 105 inches (2.67 m). Likewise, thicker batts can be folded because of the reduced dependence on friction between the conveyors to fold and pull the batts. Batts having a thickness of about 9 inches (22.9 cm) can now be folded, as compared to a maximum of about 7 inches (17.8 cm) folded with the prior art batt folder.

Figure 5:
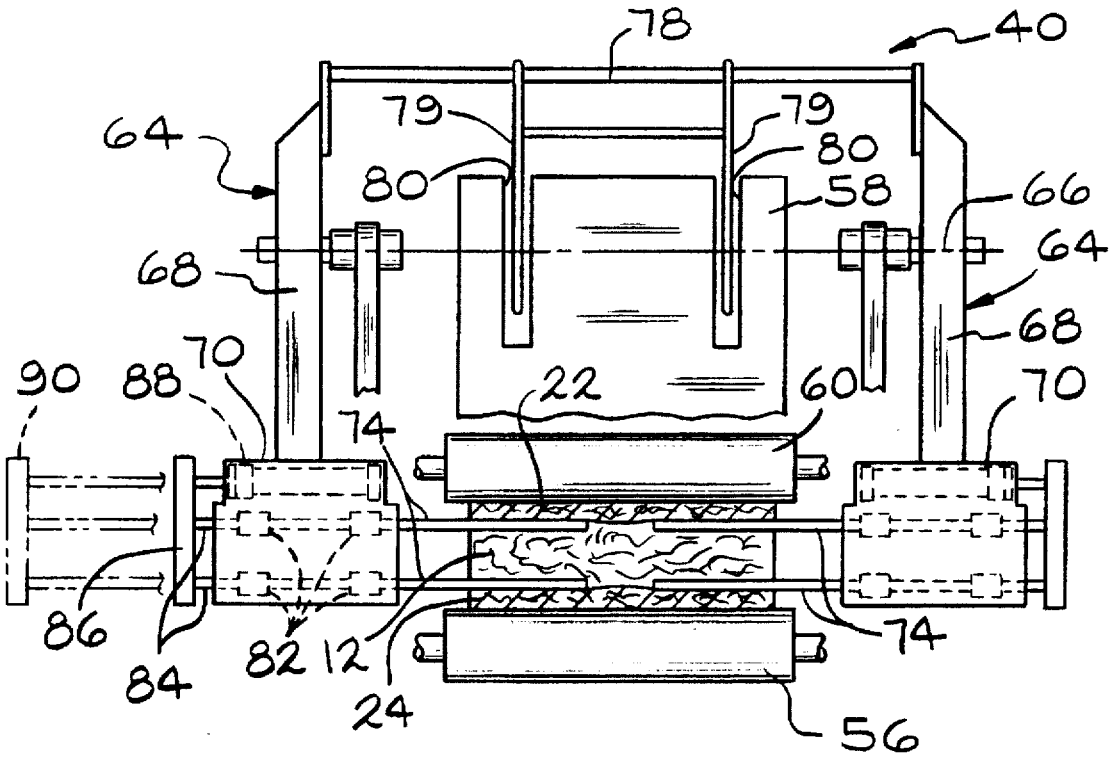
FIG. 5 is a partial cross-sectional view of the batt folder taken along lines 5—5 of FIG. 4, showing the two arms having retractable contact element rods.

The batt folder includes a deflector 78 for rotating the first section 22 of the batt around the upper conveyor to align the first section of the batt generally along the folding direction 76. Preferably, the deflector is pivotally attached to the arm so that rotation of the arm causes the deflector to push against the first section of the batt. As best seen in FIG. 5, the deflector has two legs 79 which extend from the deflector and travel through two slots 80 in the curved support plate 58.

The movement of the deflector can be seen in FIGS. 2 through 4. In FIG. 2, the deflector is in a non-active position and is out of the way so that the first section of the batt can slide up the curved support plate 30. The support plate is curved to assist in aligning the first section of the batt along the folding direction. In FIG. 3, the deflector legs are positioned to begin contact with the first section. The deflector will eventually extend in such a way as to push the first section so that it is generally aligned with the folding direction 76, as indicated by broken lines 81, as shown in FIG. 4. The deflector exerts enough force to "throw" or push the first section onto the second section, thereby folding the batt as the center of the batt is pushed into the exit path by the rods. The deflector, therefore, moves the first section of the batt into its folded position so that less stress is applied to the batt as the first section moves around the upper conveyor. Without the deflector and the curved support plate, the inertia of the first section of the batt tends to hold it back and forces the first section of the batt to be bent and severely stressed as it moves or rotates around the upper conveyor.

Referring to FIG. 5, the two pairs of retractable rods 74 are shown contacting the insulation batt 12 and inserting the batt between the upper conveyor 36 and downstream conveyor 50. Each rod is slideably mounted on the end of the arm 70 by bushings 82. The rods have ends 84 which are fastened to a pair of slide blocks 86. An actuator 88 is mounted on the end of each arm and is engaged with the slide blocks. To retract the rods from the folded batt, the actuator is actuated to push the slide block in a direction away from the batt which pulls the rods away from the batt. The retracted slide block is shown by broken lines 90. When the rods are retracted, the arm is free to pivot back up to a horizontal position, as shown in FIG. 2, for the folding of the next batt.

Figure 6:
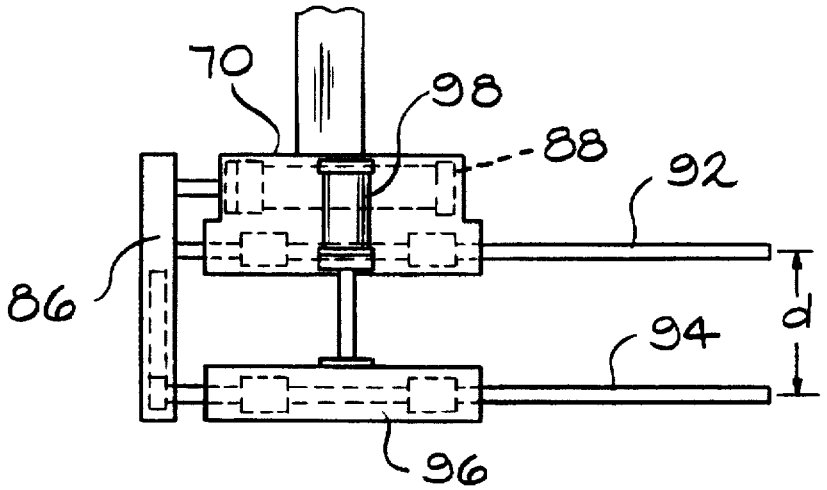
FIG. 6 is an elevational view of an embodiment of the invention having adjustable contact element rods.

The distance between the contact elements or rods can be adjustable to accommodate different insulation batt thicknesses. The rods can be adjusted in any sufficient manner, such as by threaded or slotted members. FIG. 6 illustrates an embodiment of the end 70 of arm 68 which is adjustable with respect to the distance d between the rods to accommodate different batt thicknesses. A first rod 92 is mounted to the end 70 of the arm 68. A second rod 94 is mounted to an extension bracket 96. An actuator 98 is mounted on the end of the arm and engaged with the extension bracket. To change the distance d between the first and second rods, the actuator is actuated to move the extension bracket. The end of the second rod is slideably engaged with the slide block so that the rods can be retracted independently of the position of the extension bracket and second rod.

It will be evident from the foregoing that various modifications can be made to this invention. Such, however, are considered as being within the scope of the invention.

INDUSTRIAL APPLICABILITY

The invention can be useful in the folding of fibrous insulation batts that are stacked and packaged together.

We claim:

1. An apparatus for folding a fibrous insulation batt, the batt having a length and a width, the batt having a first and second section, each section being approximately one half the length of the batt, the apparatus comprising:

a. a lower conveyor for conveying folded batts in a first direction;

b. an upper conveyor being positioned above the lower conveyor and moving in the first direction to define a folded batt exit path;

c. a folding member for folding an insulation batt, the folding member including at least two contact elements to contact one side of the batt for dual folding, and the folding member mounted for movement to initially push the batt in a second direction, and then subsequently push the batt in the first direction, thereby pushing the batt along the folded batt exit path, wherein the movement of the folding member folds the batt so that the first section of the folded bait is generally parallel to and contacting the second section.

2. The apparatus of claim 1 in which the folding member is mounted for movement in an arcuate path.

3. The apparatus of claim 1 in which the folding member is a pivotally mounted arm having said at least two contact elements positioned on the arm for contacting and pushing the batt.

4. The apparatus of claim 3 in which the contact elements are retractably mounted on the arm to enable disengagement of the contact elements from the folded insulation batt after the batt has been pushed into the folded batt exit path.

5. The apparatus of claim 1 further comprising a curved support plate for supporting the first section of the insulation batt prior to folding.

6. The apparatus of claim 1 further comprising a deflector for rotating the first section of the batt around the upper conveyor to align the first section of the batt generally along the second direction.

7. The apparatus of claim 6 in which the deflector is pivotally attached to the folding member so that the movement of the folding member causes the deflector to rotate the first section of the batt around the upper conveyor to align the first section of the batt generally along the second direction.

8. An apparatus for folding a fibrous insulation batt, the batt having a length and a width, the batt having a first and second section, each section being approximately one half the length of the batt, the apparatus comprising:

a. a lower conveyor for conveying folded batts in a first direction;

b. an upper conveyor being positioned above the lower conveyor and moving in the first direction to define a folded batt exit path;

c. a folding member mounted for movement to push the batt into the folded batt exit path; and d. at least two contact elements retractably mounted on the folding member, the contact elements mounted to contact one side of the batt and between the first and second sections for dual folding where the movement of the folding member folds the batt so that the first section of the folded batt is generally parallel to and contacting the second section, and where the contact elements are retractable to enable disengagement of the contact elements from the folded batt after the batt has been pushed into the folded batt exit path.

9. The apparatus of claim 8 in which each contact element comprises a rod extending across the width of the insulation batt.

10. The apparatus of claim 8 in which the contact elements comprise a pair of rods extending partly across the width of the batt, each rod being retractable in opposite directions.

11. The apparatus of claim 8 further comprising a curved support plate for supporting the first section of the insulation batt prior to folding.

12. The apparatus of claim 8 further comprising a deflector for rotating the first section of the batt around the upper conveyor to assist in aligning the first section of the batt in a position which is generally parallel to the second section of the batt.

13. The apparatus of claim 12 in which the deflector is pivotally attached to the folding member so that movement of the folding member causes the deflector to rotate the first section of the batt around the upper conveyor to assist in aligning the first section of the batt in a position which is generally parallel to the second section of the batt.

14. An apparatus for folding a fibrous insulation batt, the batt having a length and a width, the batt having a first and second section, each section being approximately one half the length of the batt, the apparatus comprising:

a. a lower conveyor for conveying folded batts in a first direction;

b. an upper conveyor being positioned above the lower conveyor and moving in the first direction to define a folded batt exit path; and c. a folding member mounted for movement to push the batt into the folded batt exit path; and d. first and second contact elements mounted on the folding member, the contact elements being spaced apart and mounted to contact one side of the batt and between the first and second sections, the movement of the folding member and the first and second contact elements creating two spaced apart folds across the width of the batt as the batt is being folded and pushed into the folded batt exit path so that the first section of the batt is generally parallel to and contacting the second section.

15. The apparatus of claim 14 in which the first and second contact elements are retractably mounted on the folding member to enable disengagement of the contact elements from the folded insulation batt after the batt has been pushed into the folded batt exit path.

16. The apparatus of claim 14 in which a distance between the contact elements is adjustable to accommodate different insulation batt thicknesses.

17. The apparatus of claim 14 in which the first and second contact elements each comprise a pair of rods extending partly across the width of the batt.

18. The apparatus of claim 14 further comprising a curved support plate for supporting the first section of the insulation batt prior to folding.

19. The apparatus of claim 14 further comprising a deflector for rotating the first section of the batt around the upper conveyor to assist in aligning the first section of the batt in a position which is generally parallel to the second section of the batt.

20. The apparatus of claim 19 in which the deflector is pivotally attached to the folding member so that movement of the folding member causes the deflector to rotate the first section of the batt around the upper conveyor to assist in aligning the first section of the batt in a position which is generally parallel to the second section of the batt.

* * * * *